US012378718B2

(12) United States Patent
Han et al.

(10) Patent No.: US 12,378,718 B2
(45) Date of Patent: Aug. 5, 2025

(54) CLOTHES CARE APPARATUS

(71) Applicant: SAMSUNG ELECTRONICS CO., LTD., Suwon-si (KR)

(72) Inventors: Donggi Han, Suwon-si (KR); Dongwoo Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 211 days.

(21) Appl. No.: 18/220,007

(22) Filed: Jul. 10, 2023

(65) Prior Publication Data

US 2024/0084501 A1 Mar. 14, 2024

Related U.S. Application Data

(63) Continuation of application No. PCT/KR2023/008360, filed on Jun. 16, 2023.

(30) Foreign Application Priority Data

Sep. 13, 2022 (KR) ..... 10-2022-0115240

(51) Int. Cl.
*D06F 73/02* (2006.01)
*D06F 58/10* (2006.01)

(52) U.S. Cl.
CPC ..... *D06F 73/02* (2013.01); *D06F 58/10* (2013.01)

(58) Field of Classification Search
CPC ..... D06F 73/02; D06F 58/10
See application file for complete search history.

(56) References Cited

U.S. PATENT DOCUMENTS 7,866,061 B2 1/2011 Tatsumi et al.
7,987,615 B2 8/2011 Han et al.
8,024,871 B2 9/2011 Han et al.
(Continued)

FOREIGN PATENT DOCUMENTS

EP 1586691 A2 * 10/2005 ..... D06F 58/10
JP H08215489 A * 8/1996
(Continued)

OTHER PUBLICATIONS

International Search Report dated Oct. 10, 2023 in International Patent Application No. PCT/KR2023/008360.
(Continued)

*Primary Examiner* — Benjamin L Osterhout
(74) *Attorney, Agent, or Firm* — STAAS & HALSEY LLP

(57) ABSTRACT

A clothes care apparatus including a main body having a care compartment with an exhaust port and a supply port; a heat exchanger in the main body; a blowing fan in the main body to generate airflow supplied to the care compartment through the supply port; an exhaust flow path to guide airflow from the exhaust port to pass through the heat exchanger; a circulation flow path to guide airflow from the exhaust flow path to the fan; a bypass opening to connect the care compartment and the circulation flow path; and a bypass door to open and close the bypass opening. When the bypass opening is open, at least a portion of the airflow flows directly into the circulation flow path without passing through the exhaust flow path. When the bypass opening is closed, none of the airflow flows directly from the care compartment into the circulation flow path.

15 Claims, 15 Drawing Sheets

(56) References Cited

U.S. PATENT DOCUMENTS

| | | | | |
|---|---|---|---|---|
| 8,943,843 | B2 | 2/2015 | Haryanto et al. | |
| 9,238,886 | B2 | 1/2016 | Ryoo et al. | |
| 9,745,690 | B2 | 8/2017 | Lee et al. | |
| 9,746,238 | B2 | 8/2017 | Lim et al. | |
| 10,196,772 | B2 | 2/2019 | Lee et al. | |
| 10,240,276 | B2 | 3/2019 | Ryoo et al. | |
| 11,035,066 | B2 | 6/2021 | Nam | |
| 11,492,750 | B2 | 11/2022 | Kim et al. | |
| 11,618,991 | B2 | 4/2023 | Shin et al. | |
| 11,661,700 | B2 | 5/2023 | Kang et al. | |
| 2008/0127505 | A1 | 6/2008 | Han et al. | |
| 2012/0030960 | A1* | 2/2012 | Ryoo | D06F 58/206 34/86 |
| 2021/0324566 | A1 | 10/2021 | Oak et al. | |
| 2022/0243931 | A1 | 8/2022 | Heo et al. | |
| 2022/0412579 | A1* | 12/2022 | Kim | F24F 11/72 |
| 2023/0111243 | A1 | 4/2023 | Kang | |

FOREIGN PATENT DOCUMENTS

| | | | | |
|---|---|---|---|---|
| JP | H0956992 | A * | 3/1997 | |
| JP | 2000093698 | A * | 4/2000 | |
| JP | 2002355527 | A * | 12/2002 | F24F 3/1423 |
| KR | 10-0667302 | | 1/2007 | |
| KR | 10-0808179 | | 2/2008 | |
| KR | 10-2008-0041923 | | 5/2008 | |
| KR | 10-0857791 | | 9/2008 | |
| KR | 10-0977926 | | 8/2010 | |
| KR | 10-0986910 | | 10/2010 | |
| KR | 10-2011-0019095 | | 2/2011 | |
| KR | 10-1146580 | | 5/2012 | |
| KR | 10-2012-0099073 | | 9/2012 | |
| KR | 10-1210712 | | 12/2012 | |
| KR | 10-2014-0104304 | | 8/2014 | |
| KR | 10-1613962 | | 4/2016 | |
| KR | 10-1613965 | | 4/2016 | |
| KR | 10-1632013 | | 6/2016 | |
| KR | 10-1771455 | | 8/2017 | |
| KR | 10-1773894 | | 9/2017 | |
| KR | 101989105 | B1 * | 6/2019 | |
| KR | 10-2032910 | | 11/2019 | |
| KR | 10-2020-0021359 | | 2/2020 | |
| KR | 10-2020-0081072 | | 7/2020 | |
| KR | 10-2021-0009694 | | 1/2021 | |
| KR | 10-2021-0011699 | | 2/2021 | |
| KR | 10-2021-0106954 | | 8/2021 | |
| KR | 10-2021-0149458 | | 12/2021 | |
| KR | 10-2391684 | | 4/2022 | |
| WO | WO-9321489 | A1 * | 10/1993 | F26B 21/086 |
| WO | WO 2021/162142 | A1 | 8/2021 | |

OTHER PUBLICATIONS

PCT/ISA/237 dated Oct. 10, 2023 in International Patent Application No. PCT/KR2023/008360.

* cited by examiner

CLOTHES CARE APPARATUS

CROSS-REFERENCE TO RELATED APPLICATION(S)

This application is a continuation application, under 35 U.S.C. § 111(a), of international application No. PCT/KR2023/008360, filed on Jun. 16, 2023, which claims priority to Korean Patent Application No. 10-2022-0115240, filed on Sep. 13, 2022, in the Korean Intellectual Property Office, the disclosures of which are incorporated by reference herein in their entireties.

BACKGROUND

1. Field

The disclosure relates to a clothes care apparatus.

2. Description of Related Art

In general, a clothes care apparatus refers to a device that performs washing or drying laundry. Among the clothes care apparatuses, a clothes care apparatus having a drying function is provided with a hot air supply device that supplies hot air to an accommodation space where clothes are accommodated for drying, and a steam generator configured to perform a refresh function such as wrinkle reduction, deodorization, and static removal on an object such as clothes.

The clothes care apparatus is provided with a cabinet in which a care compartment for storing clothes is formed. An electronics compartment, in which the steam generator or the hot air supply device is placed, is formed under the care compartment. The care compartment and the electronics compartment may be separated by a partition wall.

The clothes care apparatus may include a clothes support member provided in the care compartment for hanging clothes. The clothes care apparatus may perform clothes care by translational and/or rotational movement of the clothes support member, or perform the clothes care by providing airflow to the clothes support member.

SUMMARY

Aspects of embodiments of the disclosure will be set forth in part in the description which follows and, in part, will be apparent from the description, or may be learned by practice of the presented embodiments.

According to an embodiment of the disclosure, a clothes care apparatus may include a main body; a care compartment in the main body, and including an exhaust port, and a supply port; a heat exchanger disposed in the main body; a blowing fan disposed in the main body and configured to generate airflow that is supplied to the care compartment through the supply port; an exhaust flow path to guide airflow discharged from the care compartment through the exhaust port to pass through the heat exchanger; a circulation flow path to communicate with the exhaust flow path to guide airflow from the exhaust flow path to pass through the blowing fan to the supply port; a bypass opening to connect the care compartment and the circulation flow path; and a bypass door configured to open and close the bypass opening so that, when the bypass opening is open, at least a portion of the airflow supplied to the care compartment flows directly from the care compartment into the circulation flow path without passing through the exhaust flow path, and when the bypass opening is closed, none of the airflow supplied to the care compartment flows directly from the care compartment into the circulation flow path.

According to an embodiment of the disclosure, the bypass door may be configured to open the bypass opening in response to a rotational speed of the blowing fan being greater than or equal to a predetermined rotational speed.

According to an embodiment of the disclosure, the bypass door may be configured to close the bypass opening in response to the rotational speed of the blowing fan being less than the predetermined rotational speed.

According to an embodiment of the disclosure, the bypass door may include a door member configured to open and close the bypass opening, and a hinge shaft at a lower portion of the door member, and the door member may be configured to rotate about the hinge shaft.

According to an embodiment of the disclosure, the bypass door may include an elastic member configured to elastically bias the door member in a direction to close the bypass opening.

According to an embodiment of the disclosure, the elastic member may include a torsion spring.

According to an embodiment of the disclosure, the exhaust flow path may be under the care compartment, and the circulation flow path may be at a rear side of the care compartment.

According to an embodiment of the disclosure, the heat exchanger may be disposed under the care compartment, and the blowing fan may be disposed above the care compartment.

According to an embodiment of the disclosure, the bypass door may be installed to be slidable on a rear surface of the care compartment to open and close the bypass opening.

According to an embodiment of the disclosure, the exhaust port may be a first exhaust port, the exhaust flow path may be a first exhaust flow path, the clothes care apparatus may further include a second exhaust flow path arranged between the first exhaust flow path and the circulation flow path so that the first exhaust flow path and the circulation flow path to communicate with each other through the second exhaust flow path, and a second exhaust port arranged so that a portion of the airflow supplied to the care compartment is discharged through the second exhaust port to the second exhaust flow path, and the bypass opening may be disposed above the second exhaust port.

According to an embodiment of the disclosure, the clothes care apparatus may further include a steam module including a steam generator to generate steam, a steam spray port disposed at a rear side of the care compartment, and a steam spray nozzle to receive the steam from the steam generator and configured to spray the steam into the care compartment through the steam spray port, wherein the bypass opening may be disposed above the steam spray port.

According to an embodiment of the disclosure, the bypass door may include a solenoid valve.

According to an embodiment of the disclosure, the bypass door may include a step motor.

According to an embodiment of the disclosure, the bypass door may include a hydraulic cylinder.

According to an embodiment of the disclosure, the clothes care apparatus may further include a controller configured to control the bypass door to open and close the bypass opening.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
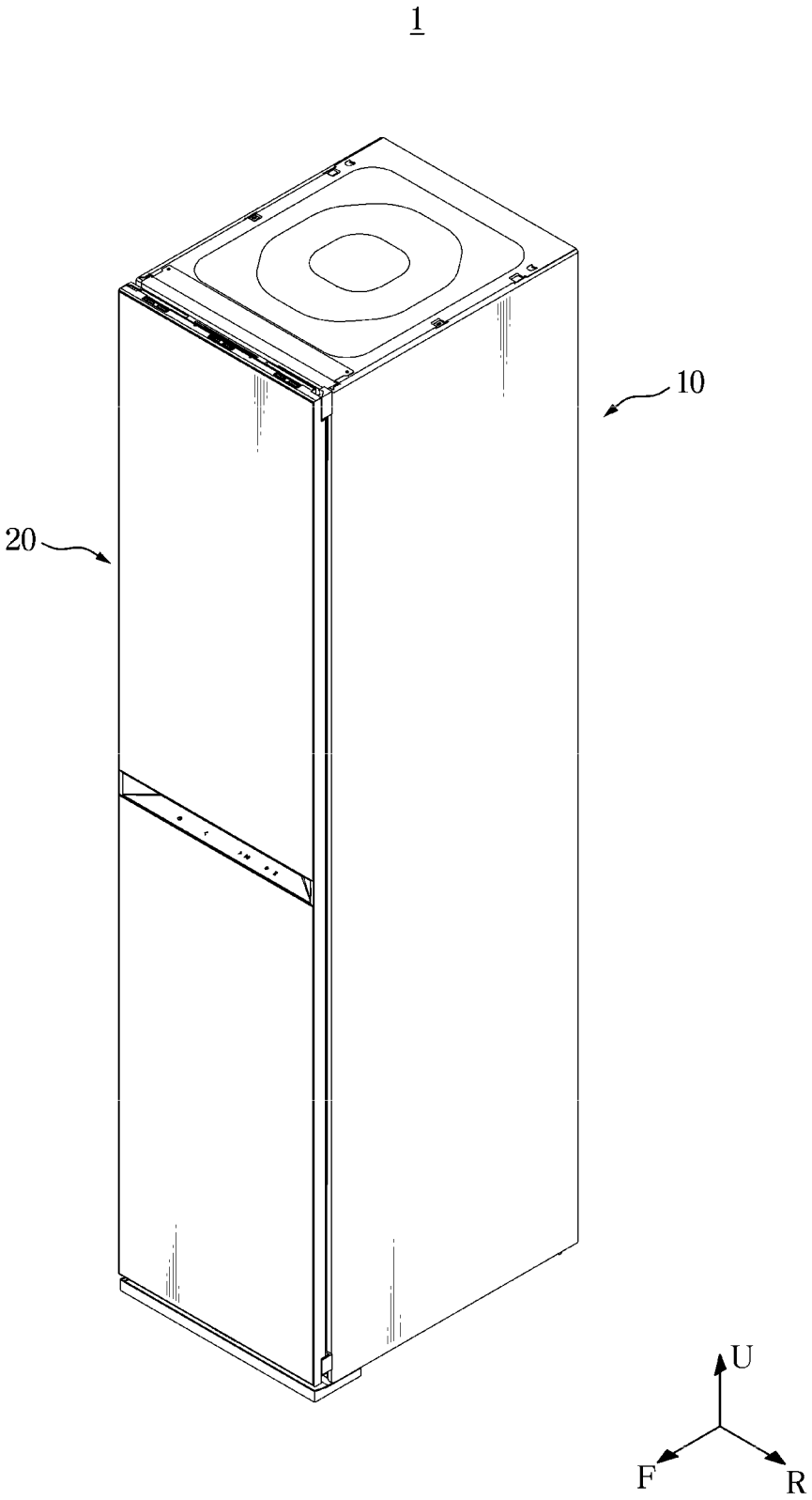
FIG. 1 is a perspective view illustrating a clothes care apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Embodiments of the disclosure may provide a clothes care apparatus including a flow path provided to bypass a heat exchanger in a fine dust course. Embodiments of the disclosure may provide a clothes care apparatus including a bypass door capable of opening and closing a bypass opening.

Hereinafter embodiments of the disclosure will be described with reference to drawings. In the following detailed description, the terms of "upper side", "lower side" and the like may be defined by the drawings, but the shape and the location of the component is not limited by the term In addition, in each drawing of the disclosure, 'F' is an abbreviation of 'Front' and may indicate a forward direction, 'R' is an abbreviation of 'Right' and may indicate a right direction, and 'U' is an abbreviation of 'Up', and may indicate an upward direction.

Figure 2:
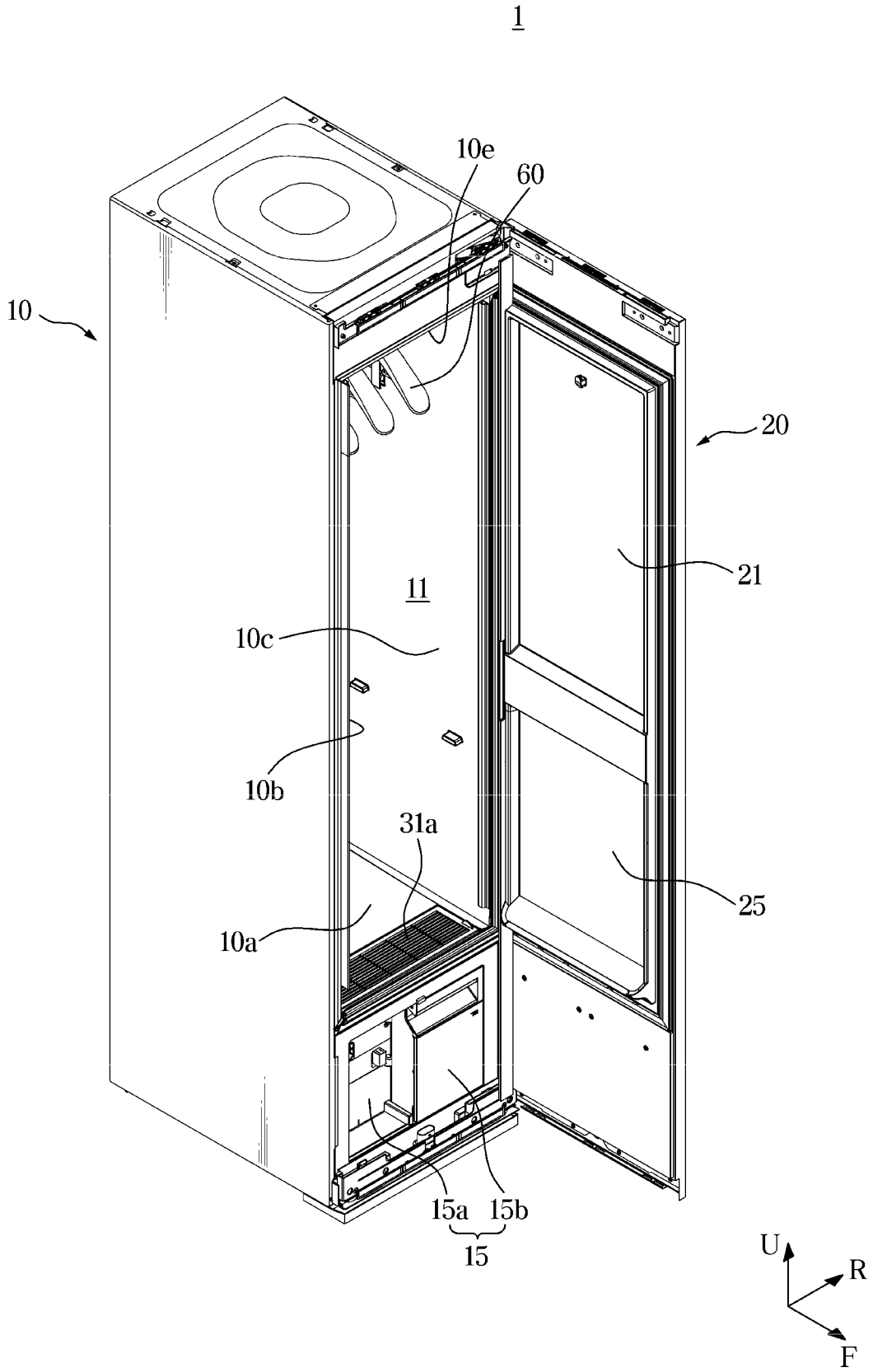
FIG. 2 is a view illustrating a state in which a door of the clothes care apparatus according to an embodiment of the disclosure is opened.
Figure 3:
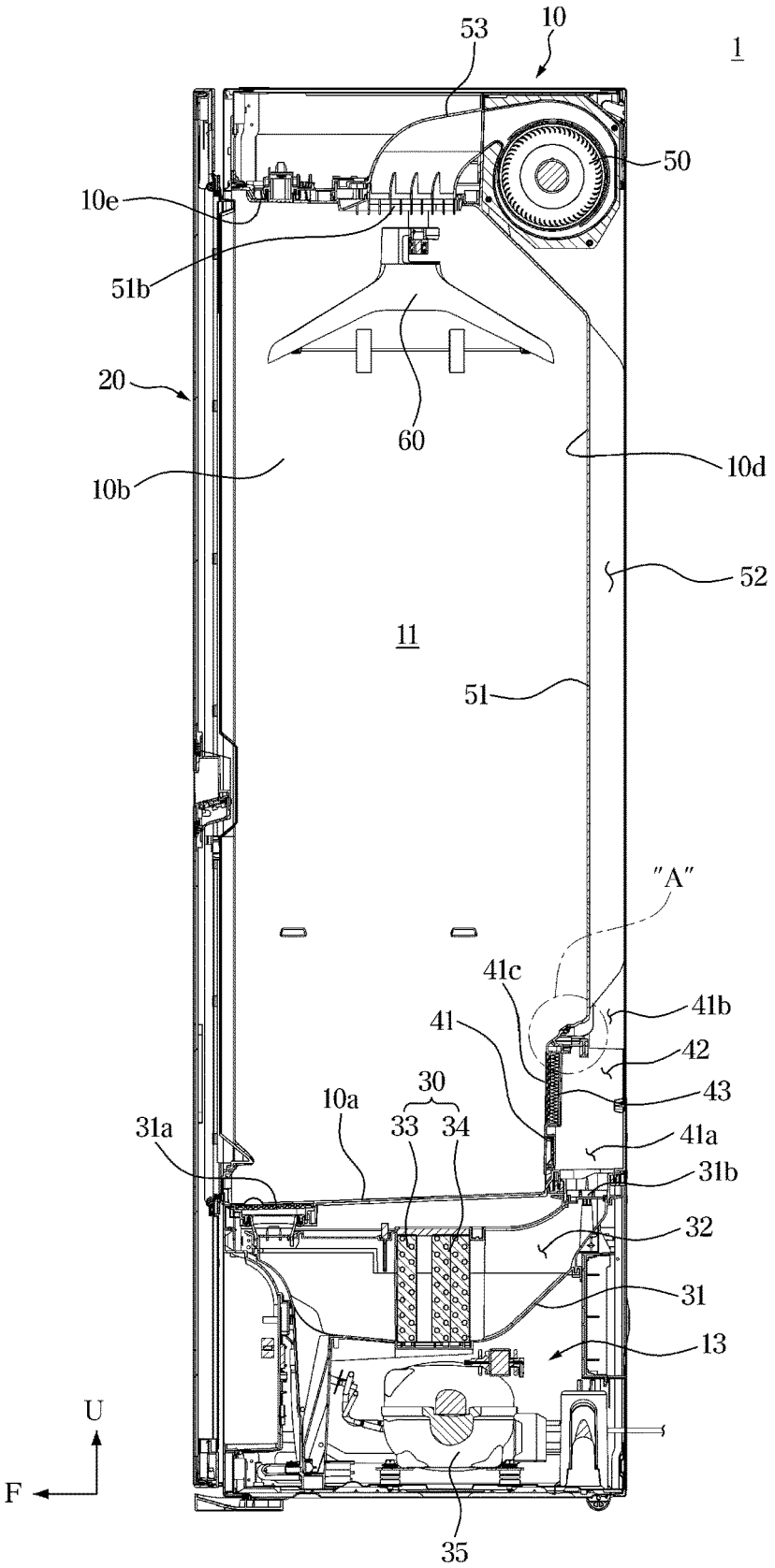
FIG. 3 is a side cross-sectional view of the clothes care apparatus according to an embodiment of the disclosure shown in FIG. 1.
Figure 4:
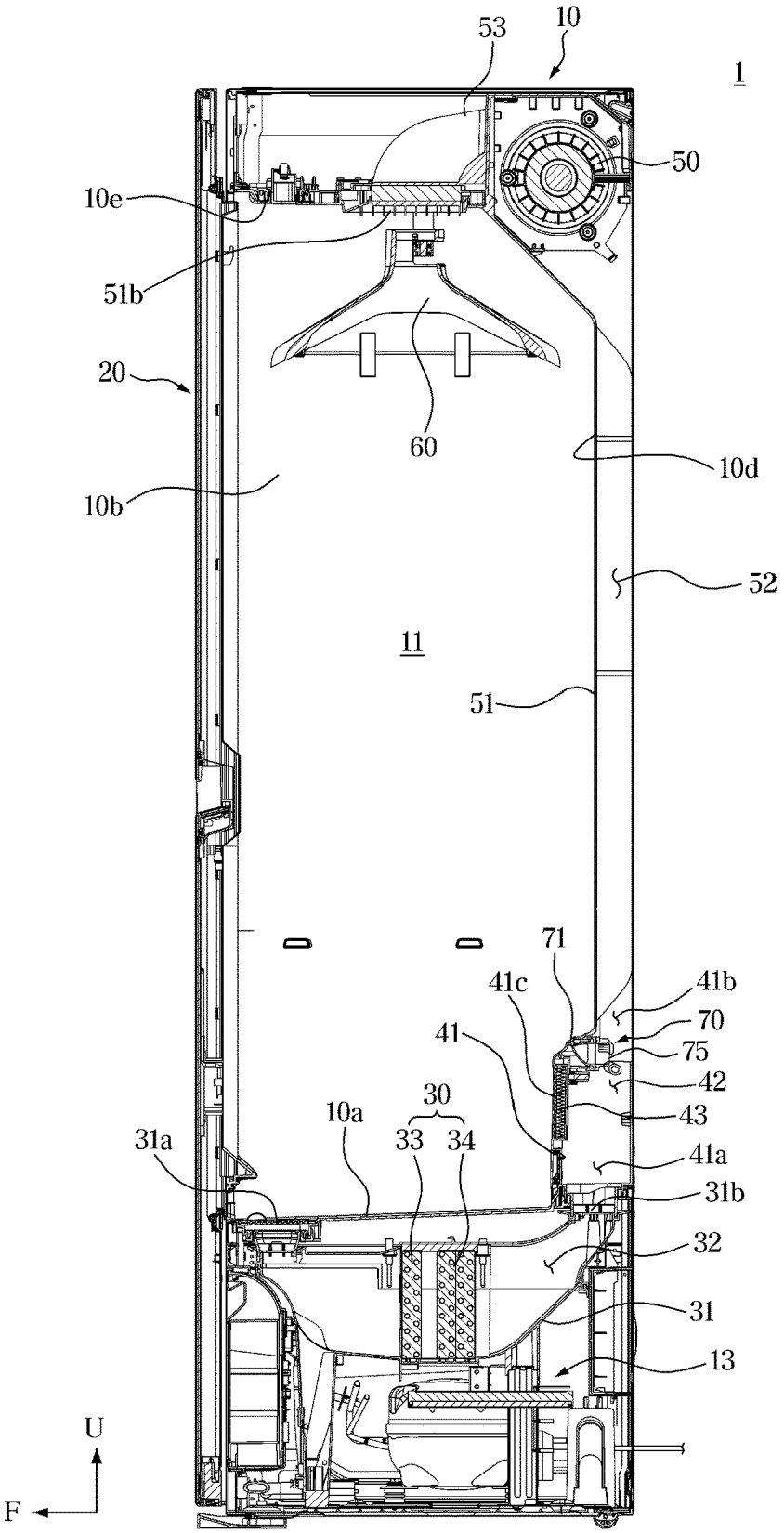
FIG. 4 is another cross-sectional view of part A of the clothes care apparatus according to an embodiment of the disclosure shown in FIG. 1.

FIG. 1 is a perspective view illustrating a clothes care apparatus according to an embodiment of the disclosure. FIG. 2 is a view illustrating a state in which a door of the clothes care apparatus according to an embodiment of the disclosure is opened. FIG. 3 is a side cross-sectional view of the clothes care apparatus according to an embodiment of the disclosure shown in FIG. 1. FIG. 4 is another cross-sectional view of part A of the clothes care apparatus according to an embodiment of the disclosure shown in FIG. 1.

Referring to FIGS. 1 to 4, a clothes care apparatus 1 may include a main body 10, and a door 20 rotatably coupled to the main body 10.

The main body 10 may be provided with a care compartment 11 in which clothes are placed and a clothes care is performed on the clothes. The care compartment 11 may be formed inside the main body 10, and the care compartment 11 may have a hexahedral shape with one surface open. A front opening may be formed on a front surface of the main body 10, and the door 20 configured to be rotated so as to open and close the front opening of the main body 10 may be installed on the main body 10.

The main body 10 includes a bottom surface 10*a*, a left surface 10*b*, a right surface 10*c*, a rear surface 10*d*, and an upper surface 10*e*, which form the care compartment 11.

A first exhaust port 31*a*, a second exhaust port 41*c*, and a supply port 51*b* may be provided in the care compartment 11 of the clothes care apparatus 1. The first exhaust port 31*a* may be formed on the bottom surface 10*a* of the care compartment 11. The second exhaust port 41*c* may be disposed on the rear surface 10*d* of the care compartment 11. The supply port 51*b* may be disposed on the upper surface 10*e* of the care compartment 11.

The first exhaust port 31*a* may be formed in a front portion of the bottom surface 10*a*. The second exhaust port 41*c* may be disposed in a lower portion of the care compartment 11. The supply port 51*b* may be disposed in a central portion of the upper surface 10*e*.

The clothes care apparatus 1 may include a steam spray port 71 disposed adjacent to the second exhaust port 41*c*. The steam spray port 71 may be disposed above the second exhaust port 41*c*. The steam spray port 71 may be disposed in a lower portion of the rear surface 10*d* of the care compartment 11.

In the lower portion of the main body 10, a water drain tank 15*a* and a water supply tank 15*b* which are separable from the main body 10 may be installed. The water drain tank 15*a* and the water supply tank 15*b* may be arranged under the care compartment 11. The water drain tank 15*a* may be configured to easily manage condensed water. The water drain tank 15*a* may be withdrawn forward from the main body 10. The water drain tank 15*a* and the water supply tank 15*b* may be components of a water supply container 15.

The water supply tank 15*b* may store water. Water stored in the water supply tank 15*b* may be supplied to a steam module 70 and used for generating steam. The water supply tank 15*b* may be removably installed to the main body 10 to easily supplement water. The water supply tank 15*b* may be withdrawn forward from the main body 10.

The water drain tank 15*a* and the water supply tank 15*b* may be provided in front of a machine room 13. The machine room 13 is provided in the lower portion of the main body 10. The machine room 13 may be provided under the care compartment 11.

The clothes care apparatus 1 may include a heat exchanger 30 configured to dehumidify and heat air inside the care compartment 11. The heat exchanger 30 may be installed to supply hot air into the care compartment 11. The heat exchanger 30 includes an evaporator 33 and a condenser 34 through which a refrigerant circulates. The heat exchanger 30 is configured to dehumidify and heat air. The heat exchanger 30 may be disposed within the main body 10. The heat exchanger 30 may be disposed below the care compartment 11.

In the evaporator 33 of the heat exchanger 30, the refrigerant evaporates while absorbing latent heat from the surrounding air, and moisture in the air is condensed and removed. In addition, when the refrigerant is condensed in the condenser 34 via a compressor 35 provided in the machine room 13, latent heat is released toward the surrounding air to heat the surrounding air. That is, the evaporator 33 and the condenser 34 may function as heat exchangers.

The clothes care apparatus 1 may include a first duct 31 provided to accommodate the evaporator 33 and the condenser 34 of the heat exchangers 30. The first duct 31 may be connected to the care compartment 11. A first exhaust flow path 32 may be formed in the first duct 31, and the first exhaust flow path 32 may circulate inside the care compartment 11 and the first duct 31. The first exhaust flow path 32 may guide airflow, which is discharged through the first exhaust port 31*a*, to allow the airflow to pass through the heat exchanger 30. The first exhaust flow path 32 may be disposed under the care compartment 11.

The first duct 31 may be connected to the first exhaust port 31*a* and a first communication port 31*b* of the care compartment 11. One end of the first duct 31 may be connected to the first exhaust port 31*a* of the care compartment 11 and the other end of the first duct 31 may be connected to the communication port 31*b*.

The clothes care apparatus 1 may include a second exhaust flow path 42 provided to communicate with the first exhaust flow path 32. The second exhaust flow path 42 may be a flow path formed by a second duct 41. The second duct 41 may be connected to a second communication port 41*a* and a rear opening 41*b*. One end of the second duct 41 may be connected to the second communication port 41*a* and the other end of the second duct 41 may be connected to the rear opening 41*b*. The second exhaust flow path 42 may be provided on a rear side of the care compartment 11.

The second exhaust flow path 42 may be connected to a second exhaust port 41*c* provided to communicate with the care compartment 11. The second exhaust port 41*c* may be provided in front of the second duct 41. A filter 43 may be provided in the second exhaust port 41*c*. However, the structure in which the filter 43 is provided in the second exhaust port 41*c* is not limited as shown in the drawing.

A circulation flow path 52 may be provided on the rear side of the care compartment 11. The circulation flow path 52 may be formed by a rear duct 51. That is, the circulation flow path 52 may be a flow path between the rear duct 51 and the main body 10. The circulation flow path 52 may communicate with the second exhaust flow path 42 and may guide the airflow, which passes through a blowing fan 50, to be supplied to the care compartment 11 through the supply port 51*b*. The circulation flow path 52 may be disposed on the rear and upper sides of the care compartment 11.

The circulation flow path 52 may be formed to pass through the blowing fan 50. The blowing fan 50 may be disposed above the care compartment 11. The blowing fan 50 may be provided between the care compartment 11 and the main body 10. The blowing fan 50 may be provided in the main body 10 to generate airflow supplied to the care compartment 11.

An upper cover 53 may be provided on the upper side of the blowing fan 50. The upper cover 53 may be provided to guide the airflow flowing by the blowing fan 50 to the supply port 51*b*.

A clothes support member 60 adjacent to the supply port 51*b* to support clothes may be disposed in the care compartment 11. The clothes support member 60 may support clothes in the care compartment 11 and include a through hole (not shown). Accordingly, the clothes support member 60 may be configured to allow airflow to pass through an inside and outside of the clothes.

The machine room 13 may further include the steam module 70 configured to generate steam by receiving water from the water supply tank 15*b*. The steam module 70 may be disposed in the machine room 13. The steam module 70 may include a steam generator (not shown) connected to the water supply tank 15*b* to receive water and generate steam, and a steam supply pipe (not shown) provided to guide the generated steam to the steam spray port 71. A steam spray nozzle 75 may be disposed in the lower portion of the rear surface 10*d* of the care compartment 11. A heater (not shown) may be installed inside the steam spray nozzle to heat water.

Figure 5:
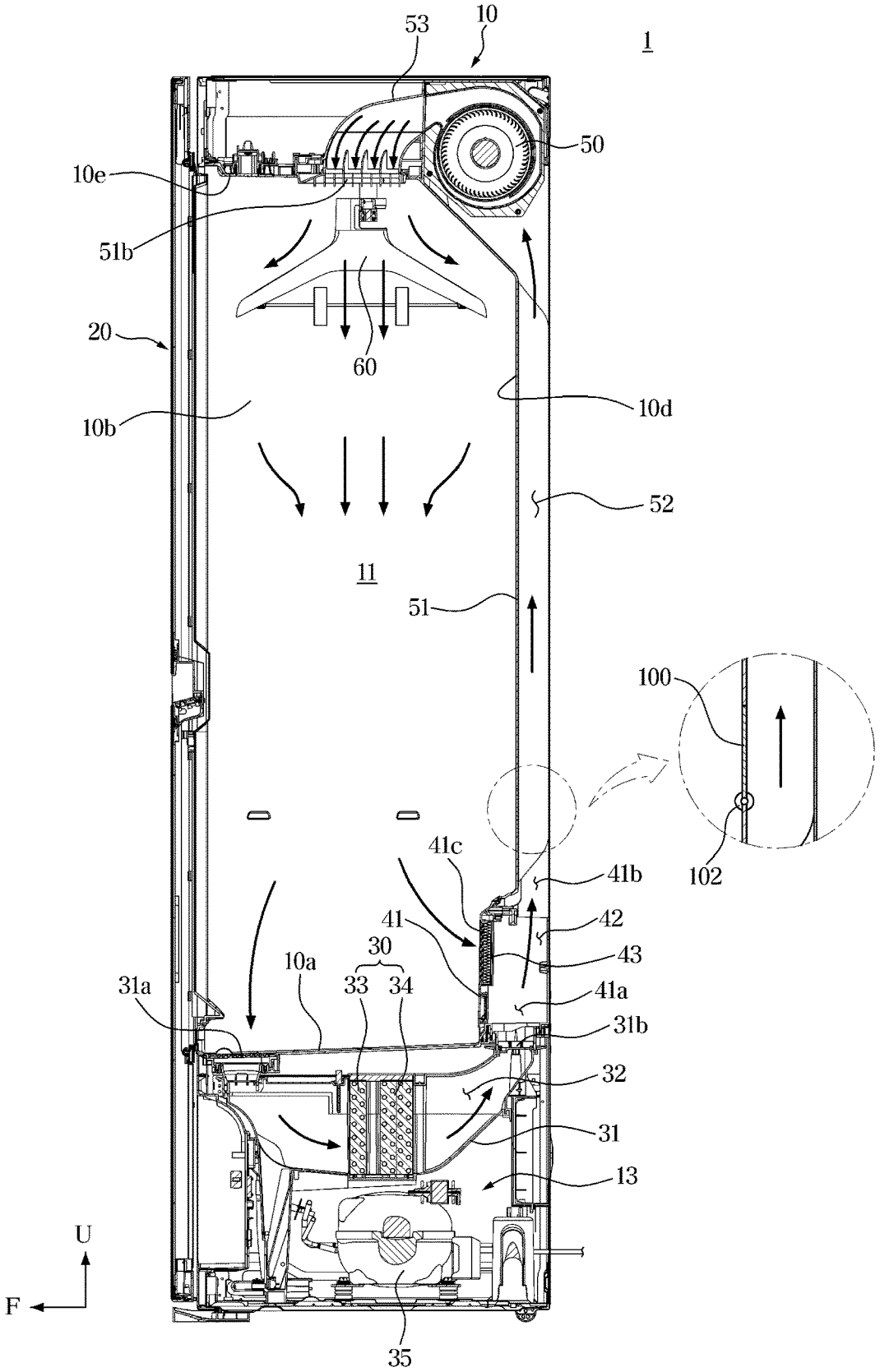
FIG. 5 is a cross-sectional side view illustrating airflow when the clothes care apparatus according to an embodiment of the disclosure is in a standard course.
Figure 6:
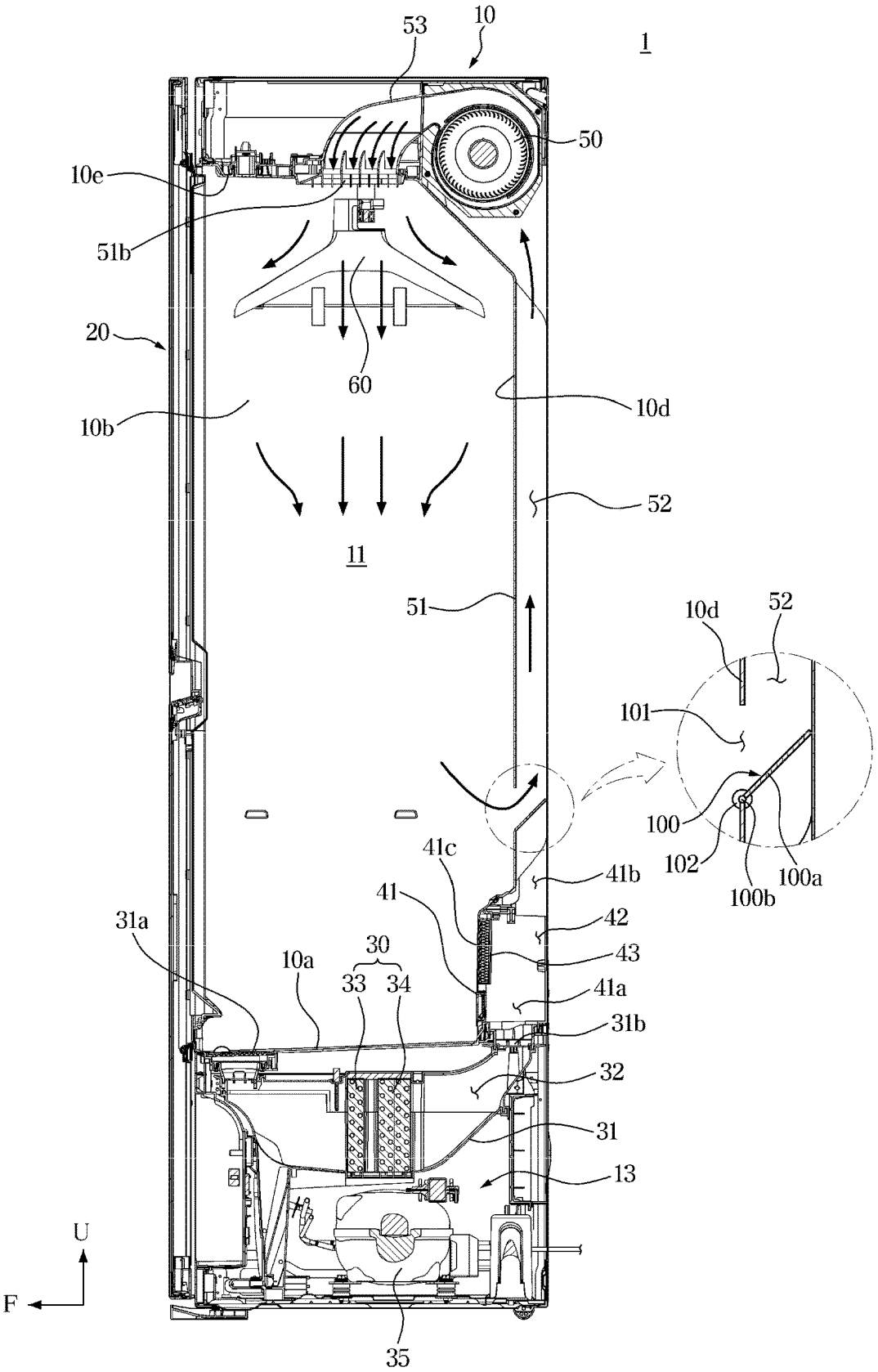
FIG. 6 is a cross-sectional side view illustrating airflow when the clothes care apparatus according to an embodiment of the disclosure is in a fine dust course.

FIG. 5 is a cross-sectional side view illustrating airflow when the clothes care apparatus according to an embodiment of the disclosure is in a standard course. FIG. 6 is a cross-sectional side view illustrating airflow when the clothes care apparatus according to an embodiment of the disclosure is in a fine dust course.

Airflow according to the standard course and the fine dust course of the clothes care apparatus 1 will be described with reference to FIGS. 5 and 6. The clothes care apparatus 1 may drive the blowing fan 50 differently according to the standard course, a sterilization course, a deodorization course, and the fine dust course.

When the clothes care apparatus 1 is in the standard course, airflow generated by the blowing fan 50 may pass through the care compartment 11 through the supply port 51*b*. At this time, a portion of the airflow in the care compartment 11 may pass through the heat exchanger 30 through the first exhaust port 31*a* and flow into the second exhaust flow path 42 through the first exhaust flow path 32.

Another portion of the airflow of the care compartment 11 may be introduced into the second exhaust flow path 42 through the second exhaust port 41*c* and may meet airflow passing through the first exhaust flow path 32. Because the second exhaust flow path 42 communicates with the circulation flow path 52, the airflow introduced into the second exhaust flow path 42 through the first exhaust flow path 32 and the second air supply port 41*c* may pass through the blowing fan 50 of the circulation flow path 52.

As an example, in the standard course of the clothes care apparatus 1, the blowing fan 50 may be rotated at approximately 1750 rpm to 1800 rpm. The 'rpm' may be 'revolutions per minute'. In the fine dust course of the clothes care apparatus 1, the blowing fan 50 may be rotated at about 2200 rpm.

Accordingly, the rotational speed of the blowing fan 50 of the clothes care apparatus 1 in the fine dust course may be increased by 15% to 20% in comparison with the standard course. As the rpm of the blowing fan 50 increases, an air pressure in the care compartment 11 may be relatively higher than that of the standard course.

For example, in the fine dust course, a blowing fan 50 having a high speed is required in comparison with the standard course. When a portion of the airflow generated by the high-speed blowing fan 50 passes through the heat exchanger 30, it may be required for the blowing fan 50 to be rotated faster for increasing the air volume.

In the case of the fine dust course, a load of the heat exchanger 30 located under the care compartment 11 is relatively greater than the standard course, and in terms of an entire system, it is possible to reduce a resistance of the system by bypassing the heat exchanger 30, and thus it is possible to increase an efficiency.

On the other hand, when the airflow passing through the heat exchanger 30 is reduced during the fine dust course, the system efficiency of the clothes care apparatus 1 may be improved, and thus even when the rotational speed of the blowing fan 50 is maintained at the same, an air volume above a certain speed may be generated. For this, the clothes care apparatus 1 may include a bypass opening 101 provided to connect the care compartment 11 and the circulation flow path so as to allow a portion of the airflow of the care compartment 11 to be directly introduced into the circulation flow path 52 without passing through the first exhaust flow path 32 during the fine dust course.

The bypass opening 101 may be provided on the rear surface 10*d* of the care compartment 11. The clothes care apparatus 1 may include a bypass door 100 configured to open and close the bypass opening 101.

The bypass opening 101 may be provided to allow a portion of the airflow in the care compartment 11 to be directly introduced from the care compartment 11 into the circulation flow path 52 without passing through the first exhaust flow path 32 and the second exhaust flow path 42 during the fine dust course. The bypass opening 101 may be formed to connect the care compartment 11 and the circulation flow path 52.

The bypass door 100 may be provided to open the bypass opening 101 in response to the air of the care compartment 11 in the fine dust course being relatively higher-pressure than in the standard course.

Due to this structure, because the bypass door 100 opens the bypass opening 101 in response to an air pressure of the care compartment 110 being greater than or equal to a predetermined pressure, the clothes care apparatus 1 may open the bypass opening 101 only in the fine dust course.

Accordingly, the clothes care apparatus 1 may include a flow path that does not pass through the exhaust flow paths 32 and 42 even without separate control during the fine dust course. The clothes care apparatus 1 may include the flow path that passes through the heat exchanger 30 in the standard course and that bypasses the heat exchanger 30 in the fine dust course. Accordingly, the efficiency may be improved in the specific course.

That is, as shown in FIG. 6, the bypass door 100 may open the bypass opening 101 in response to the rotational speed of the blowing fan 50 being greater than or equal to a predetermined rotational speed. Further, as shown in FIG. 5, the bypass door 100 may close the bypass opening 101 in response to the rotational speed of the blowing fan 50 being less than the predetermined rotational speed. The predetermined rotational speed may be a rotational speed of 1800 rpm to 2200 rpm.

The bypass door 100 may include a door member 100*a*, a hinge shaft 100*b*, and an elastic member 102. The door member 100*a* may be formed to open and close the bypass opening 101. The hinge shaft 100*b* may be provided on a lower portion of the door member 100*a* to rotate the door member 100*a* with respect to the rear surface 10*d* of the care compartment 11.

A reason why the hinge shaft 100*b* is positioned in the lower portion of the door member 100*a* is to open the bypass opening 101 by rotating the door member 100*a* clockwise. Due to this structure, the door member 100*a* may be rotated clockwise by the high-pressure airflow in the care compartment 11, and the airflow may circulate directly from the care compartment 11 to the circulation flow path 52.

However, the arrangement of the hinge shaft 100*b* is not limited thereto, and it is sufficient for the hinge shaft 100*b* to open and close the bypass opening 101 by rotating the door member 100*a*.

The elastic member 102 may be a torsion spring 102. The torsion spring 102 may be formed to surround the hinge shaft 100*b*. One end of the torsion spring 102 may be connected to the door member 100*a* and the other end of the torsion spring 102 may be connected to the rear duct 51. Accordingly, the torsion spring 102 may elastically bias the door member 100*a*, which is rotated to open the bypass opening 101, counterclockwise.

That is, in response to the rotational speed of the blowing fan 50 being greater than or equal to a predetermined rotational speed, the door member 100*a* may be rotated clockwise to open the bypass opening 101 by the high pressure in the care compartment 11. In addition, in response to the rotational speed of the blowing fan 50 being less than the predetermined rotational speed, the door member 100*a* may be rotated counterclockwise by the torsion spring 102, thereby closing the bypass opening 101.

Due to this structure, as the bypass opening 101 is closed without a separate control operation in the standard course, the clothes care apparatus 1 may allow the airflow of the care compartment 11 to be introduced into the circulation flow path 52 via the first exhaust flow path 32 or the second exhaust flow path 42. As the bypass door 100 opens the bypass opening 101 by the high pressure of the care compartment 11 without a separate control operation in the fine dust course, the clothes care apparatus 1 may allow a relatively large portion of the airflow of the care compartment 11 to be introduced into the circulation flow path 52 without passing through the first exhaust flow path 32.

A separate filter may be arranged in the bypass door 100. The bypass opening 101 may be disposed above the second exhaust port 41*c*. Because the bypass opening 101 is disposed above the second exhaust port 41*c*, the airflow in the care compartment 11 may be guided to the circulation flow path 52 through the bypass opening 101 without passing through the second exhaust port 41*c* in the fine dust course. However, the location of the bypass opening 101 is not limited thereto, and the bypass opening 101 may be disposed below the second exhaust port 41*c*.

The bypass opening 101 may be disposed above the steam spray port 71. However, it is not limited thereto, and the bypass opening 101 may be disposed below the steam spray port 71.

Figure 7:
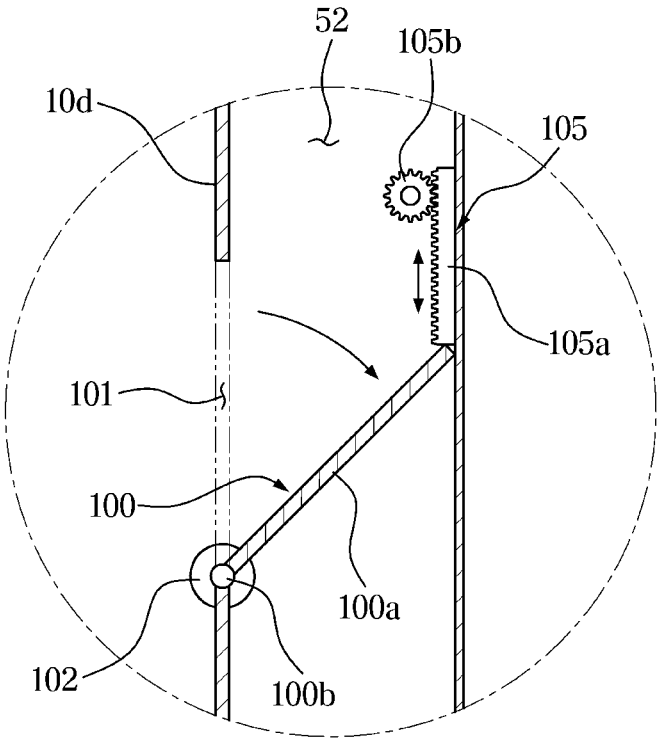
FIG. 7 is an enlarged view of a locker fixing a position of a bypass door according to an embodiment of the disclosure.

FIG. 7 is an enlarged view of a locker fixing a position of a bypass door according to an embodiment of the disclosure. Referring to FIG. 7, the clothes care apparatus 1 (refer to FIG. 1) may include a locker 105 configured to fix the position of the bypass door 100.

The locker 105 may include a pinion gear 105*b* and an interference member 105*a*. The locker 105 may be provided in the circulation flow path 52 and may be driven by a controller 150 (refer to FIG. 12).

The locker 105 may rotate the pinion gear 105*b* in response to the rotation of the bypass door 500 based on the rotational speed of the blowing fan 50 being greater than or equal to a predetermined speed. When the pinion gear 105*b* is rotated clockwise, the interference member 105*a* including a rack gear engaged with the pinion gear 105*b* may be moved downward. The interference member 105*a* is moved downward by the clockwise rotation of the pinion gear 105*b* so as to interfere with the door member 100*a*.

Due to this structure, when the blowing fan 50 is in the fine dust course, the door member 100*a* may not be rotated counterclockwise but may be fixed in a position in which the bypass opening 101 is opened.

When the clothes care apparatus 1 is in the standard course, the controller 150 may reversely rotate the pinion gear 105*b* to allow the interference member 105*a* to be moved upward and accordingly, the door member 100*a* may be rotated counterclockwise by the torsion spring 102 to cover the bypass opening 101.

Due to this structure, when the clothes care apparatus 1 is in the fine dust course, it is possible to prevent the door member 100*a* from being rotated by the airflow being introduced into the circulation flow path 52 through the second exhaust flow path 42 or the first exhaust flow path 32, and thus the position of the door member 100*a* may be fixed.

Figure 8:
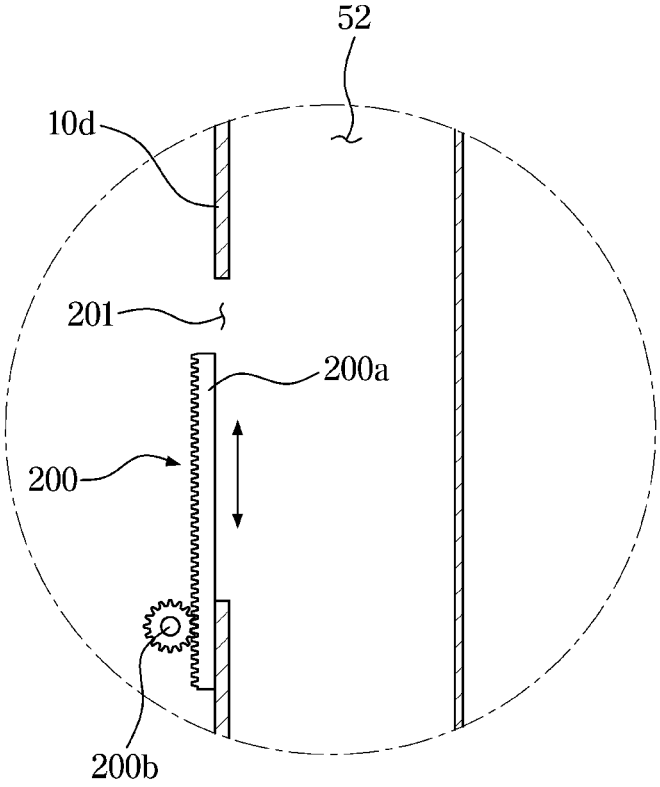
FIG. 8 is an enlarged view of a bypass door according to an embodiment of the disclosure.

FIG. 8 is an enlarged view of a bypass door according to an embodiment of the disclosure. Referring to FIG. 8, the clothes care apparatus 1 (refer to FIG. 1) may include a bypass door 200 configured to open and close a bypass opening 201.

The bypass door 200 may be slidably installed on the rear surface 10*d* of the care compartment 11 (refer to FIG. 6). The bypass door 200 may slide so as to open or close the bypass opening 201.

The bypass door 200 may include a bypass pinion gear 200*b* and a door member 200*a* engaged with the bypass pinion gear 200*b*. The bypass door 200 may be driven to open the bypass opening 201 by the controller 150 (refer to FIG. 12) in response to the blowing fan 50 (refer to FIG. 6) having a predetermined rotational speed or more.

The bypass pinion gear 200*b* may be rotated clockwise by the controller 150, and as a result, the door member 200*a* may be moved downward. Accordingly, the bypass door 200 may be controlled to open the bypass opening 201 by the controller 150 in response to the rotational speed of the blowing fan 50 being greater than or equal to a predetermined rotational speed.

On the other hand, in response to the rotational speed of the blowing fan 50 being less than the predetermined rotational speed, the bypass pinion gear 200*b* may be rotated counterclockwise, and as a result, the door member 200*a* may be moved upward to close the bypass opening 201. Accordingly, the clothes care apparatus 1 in the fine dust course may guide a portion of the airflow in the care compartment 11 to the circulation flow path 52 via the bypass opening 201, and the clothes care apparatus 1 in the standard course may guide the airflow in the care compartment 11 to the circulation flow path 52 via the first exhaust flow path 31 and the second exhaust flow path 42.

Figure 9:
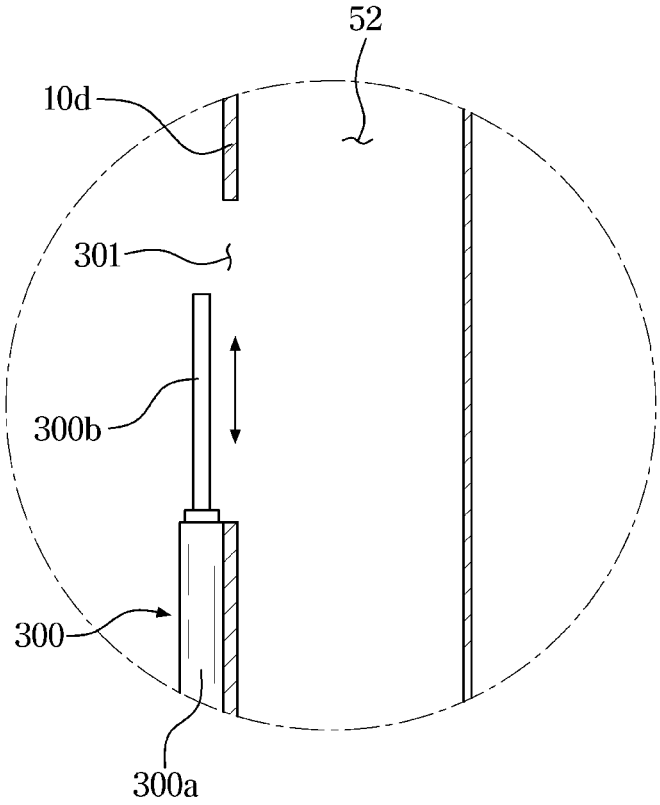
FIG. 9 is an enlarged view of a bypass door according to an embodiment of the disclosure.

FIG. 9 is an enlarged view of a bypass door according to an embodiment of the disclosure. Referring to FIG. 9, the clothes care apparatus 1 (refer to FIG. 1) may include a bypass door 300 configured to open and close a bypass opening 301 provided on the rear surface 10*d* of the care compartment 11.

The bypass door 300 may include a cylinder 300*a* and a door member 300*b* movable in a vertical direction by the cylinder 300*a*. The cylinder 300*a* may be a hydraulic cylinder 300*a*.

Figure 12:
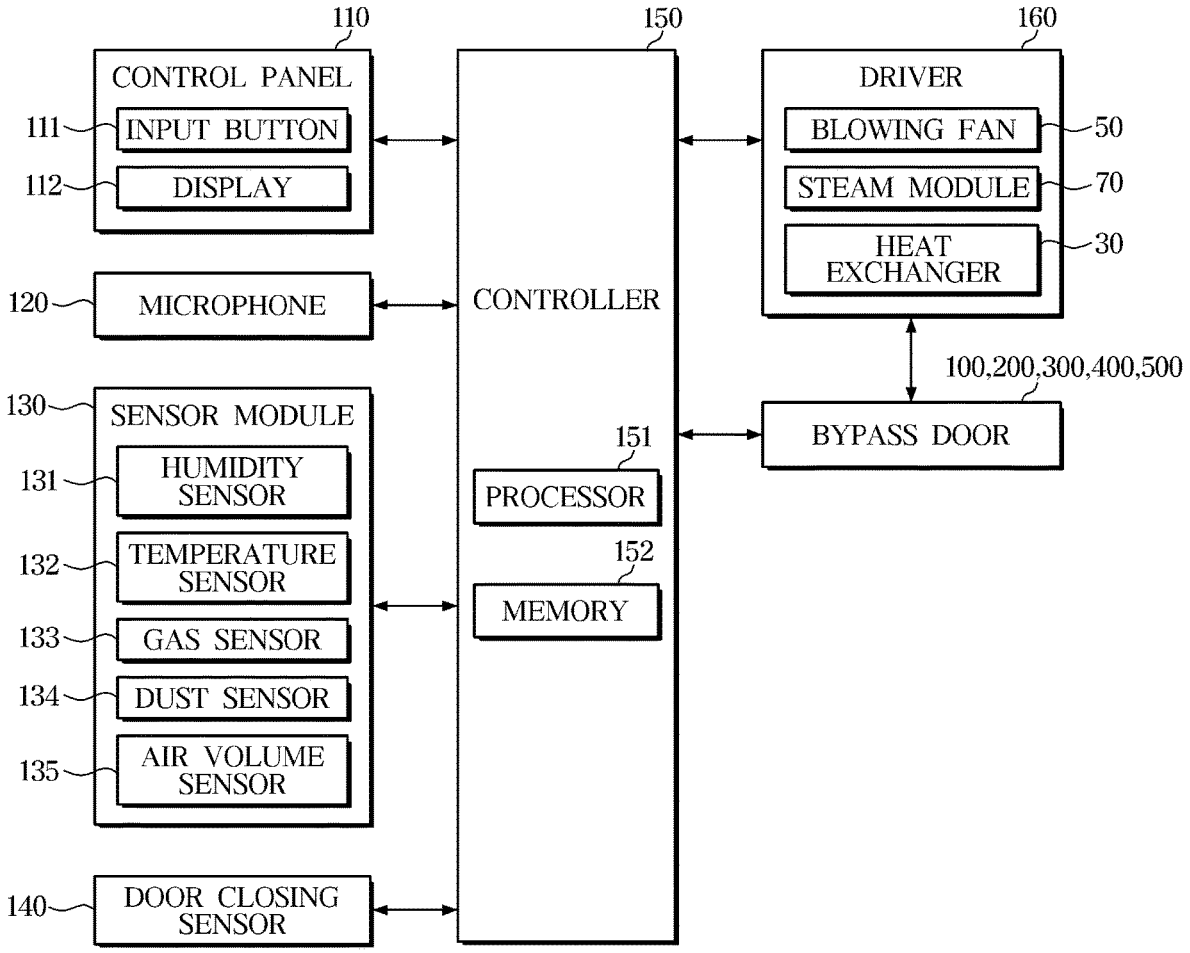
FIG. 12 is a block diagram illustrating a configuration of the clothes care apparatus according to an embodiment of the disclosure.

As for the bypass door 300, a portion of the door member 300*b* inserted into the cylinder 300*a* may be adjusted by the controller 150 (refer to FIG. 12). Particularly, in response to a rotational speed of the blowing fan 50 (refer to FIG. 6) being greater than or equal to a predetermined rotational speed, the controller 150 may draw fluid such as oil from the cylinder 300*a* to allow the door member 300*b* to be moved downward. Further, in response to the rotational speed of the blowing fan 50 being less than the predetermined rotational speed, the controller 150 may insert fluid such as oil into the cylinder 300*a* to allow the door member 300*b* to be moved upward.

Due to this structure, the door member 300*b* may open the bypass opening 301 only in the fine dust course rather than the standard course, and thus the load of the heat exchanger 30 may be reduced while the efficiency of the entire clothes care apparatus 1 may be increased.

Figure 10:
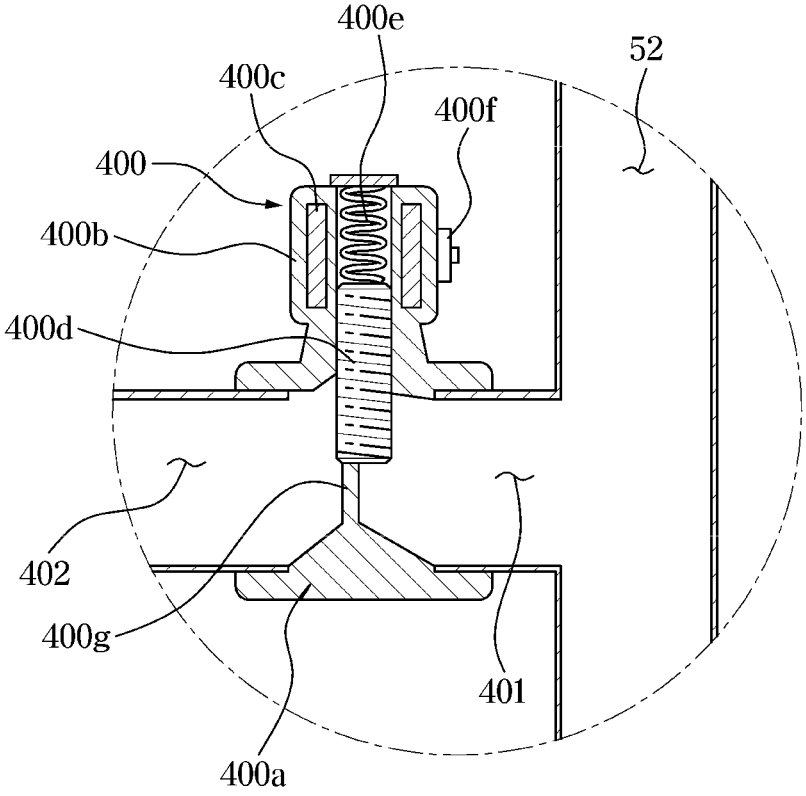
FIG. 10 is an enlarged view of a bypass door according to an embodiment of the disclosure.

FIG. 10 is an enlarged view of a bypass door according to an embodiment of the disclosure. Referring to FIG. 10, the clothes care apparatus 1 (refer to FIG. 1) may include a bypass door 400 configured to open and close a bypass opening 401.

The bypass door 400 may include a solenoid valve 400. The solenoid valve 400 may include a lower body 400*a* and an upper body 400*b*. The solenoid valve 400 may include a coil lead wire 400*f* connected to the upper body 400*b* and a core 400*c* configured to adjust a magnetic flux as a voltage is applied through the coil lead wire 400*f*.

The solenoid valve 400 may include a shaft 400*d* configured to be moved by the core 400*c* and a shaft elastic member 400*e* configured to elastically bias the shaft 400*d*. The solenoid valve 400 may include a solenoid opening 402 provided to communicate with the bypass opening 401.

When a voltage is applied to the coil lead wire 400*f* of the solenoid valve 400, the magnetic field of the core 400*c* may be changed, and the shaft 400*d* may be moved downward to be in contact with a locking wall 400*g*. Accordingly, because the solenoid opening 402 and the bypass opening 401 do not communicate with each other, the circulation flow path 52 and the care compartment 11 may not communicate directly.

On the other hand, in response to a voltage not being applied to the coil lead wire 400*f* of the solenoid valve 400, the shaft 400*d* may be moved upward by the shaft elastic member 400*e* and spaced apart from the locking wall 400*g*. Accordingly, because the solenoid opening 402 and the bypass opening 401 communicate with each other, the circulation flow path 52 and the care compartment 11 may directly communicate with each other.

The controller 150 (refer to FIG. 12) may not apply a voltage to the coil lead wire 400*f* of the solenoid 400 in response to the rotational speed of the blowing fan 50 (refer to FIG. 6) being greater than or equal to the predetermined rotational speed. In addition, the controller 150 may apply a voltage to the coil lead wire 400*f* of the solenoid 400 in response to the rotational speed of the blowing fan being less than the predetermined rotational speed.

Due to this structure, in the standard course of the clothes care apparatus 1, the shaft 400*d* of the solenoid valve 400 may be moved downward and thus the solenoid opening 402 and the bypass opening 401 may be separated from each other. In the fine dust course of the clothes care apparatus 1, the shaft 400*d* of the solenoid valve 400 may be moved upward and thus the solenoid opening 402 and the bypass opening 401 may communicate with each other.

Due to this structure, in the fine dust course, the controller 150 may open the bypass opening 401 so as to bypass the heat exchanger 30 (refer to FIG. 6) by using the shaft 400*d*, and thus the overall efficiency of the system may be increased.

Figure 11:
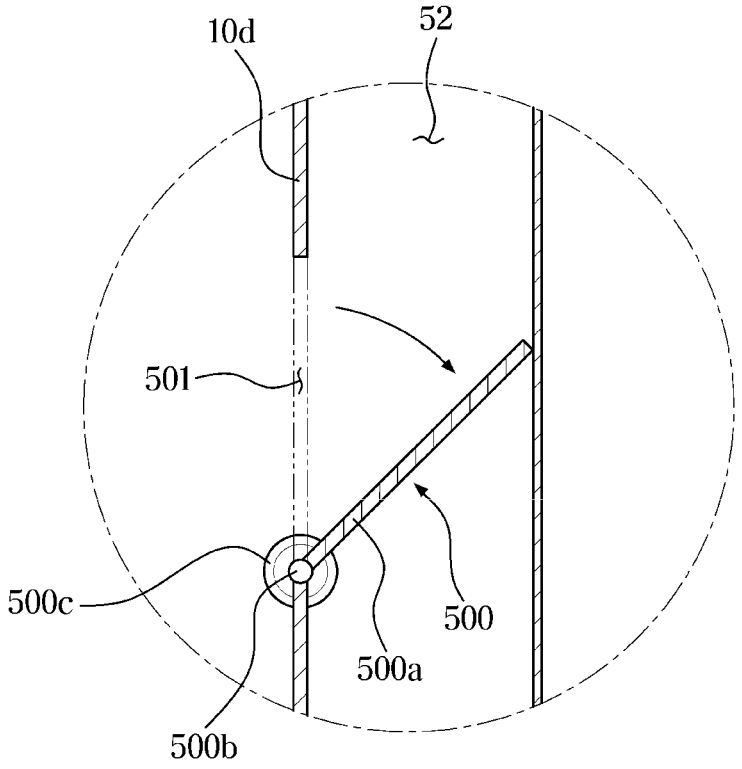
FIG. 11 is an enlarged view of a bypass door according to an embodiment of the disclosure.

FIG. 11 is an enlarged view of a bypass door according to an embodiment of the disclosure. Referring to FIG. 11, the clothes care apparatus 1 may include a bypass door 500 configured to open and close a bypass opening 501 provided on the rear surface 10*d* of the care compartment 11.

The bypass door 500 may include a door member 500*a* provided to cover the bypass opening 501 and a hinge shaft 500*b* configured to rotate the door member 500*a*. The bypass door 500 may include a step motor 500*c* configured to adjust an angle of the hinge shaft 500*b*.

The step motor 500*c* may include a stator (not shown) disposed in a circumferential direction of the hinge shaft 500*b* and a rotor (not shown) coupled to the hinge shaft 500*b*.

An electromagnetic force generated from the stator to the rotor may allow the rotor to be rotated. Accordingly, the hinge shaft 500*b* coupled to the rotor may be rotated by a predetermined angle, so as to open and close the bypass opening 501.

That is, the controller 150 (refer to FIG. 12) may rotate the step motor 500*c* to allow the rotor of the step motor 500*c* to be rotated when the clothes care apparatus 1 is in the fine dust course. When the hinge shaft 500*b* is rotated according to a desired angle, the bypass door 500 may open the bypass opening 501 and thus a portion of the airflow in the care compartment 11 (refer to FIG. 6) may be directly introduced into the circulation flow path 52.

Accordingly, the door member 500*a* may close the bypass opening 501 in the standard course, and the door member 500*a* may open the bypass opening 501 in the fine dust course.

FIG. 12 is a block diagram illustrating a configuration of the clothes care apparatus according to an embodiment of the disclosure. Referring to FIG. 12, the clothes care apparatus 1 may include a control panel 110, a microphone 120, a sensor module 130, a door closing sensor 140, the controller 150, and a driver 160.

The control panel 110 may provide a user interface for interaction with a user. The control panel 110 may be provided on the main body 10 or on the door 20. For example, the control panel 110 may be provided outside the door 20.

The control panel 110 may include an input button 111 and/or a display 112.

The input button 111 may obtain a user input related to the operation of the clothes care apparatus 1. For example, the input button 111 may obtain a user input for opening the door 20. For example, the input button 111 may obtain a user input for controlling a clothes care course of the care compartment 11.

The input button 111 may provide an electrical signal (user signal) (e.g., a voltage signal or a current signal) corresponding to a user input to the controller 150. The controller 150 may identify the user input based on processing of the user input signal.

The input button 111 may include a tact switch, a push switch, a slide switch, a toggle switch, a micro switch, or a touch switch.

The display 112 may obtain operation information of the clothes care apparatus 1 from the controller 150 and display the operation information of the clothes care apparatus 1. For example, the display 112 may display opening or closing of the door 20. For example, the display 112 may display the measured temperature or humidity or pressure of the care compartment 11.

The display 112 may display the obtained user input related to the operation of the clothes care apparatus 1. For example, the display 112 may display a user input for opening the door 20. The display 112 may display a user input for the clothes course of the clothes care apparatus 1.

The display 112 may include a Liquid Crystal Display (LCD) panel, a Light Emitting Diode (LED) panel, or the like.

The microphone 120 may obtain a sound wave (e.g., voice or sound) and convert the obtained sound wave into an electrical signal (voice signal) (e.g., a current signal or a voltage signal). For example, the microphone 120 may obtain a user input and convert the voice into an electrical signal.

The microphone 120 may provide the electrical signal (voice signal) to the controller 150. The controller 150 may identify the user input by the voice based on processing of the voice signal.

The sensor module 130 may include a humidity sensor 131, a temperature sensor 132, a gas sensor 133, a dust sensor 134, and an air volume sensor 135. The humidity sensor 131 may be provided inside the main body 10 or the door 20 to detect a humidity of the care compartment 11. The temperature sensor 132 may be provided inside the main body 10 or the door 20 to detect a temperature of the care compartment 11.

The gas sensor 133 and the dust sensor 134 may be provided inside the main body 10 or the door 20 to detect an amount of gas or dust in the care compartment 11. That is, the gas sensor 133 and the dust sensor 134 may detect a degree of contamination of the air in the care compartment 11.

The air volume sensor 135 may be provided inside the main body 10 or the door to detect an air volume in the care compartment 11.

The sensor module 130 may transmit electrical signals output from the humidity sensor 131, the temperature sensor 132, the gas sensor 133, the dust sensor 134, and the air volume sensor 135 to the controller 150.

The door closing sensor 140 may detect that the door 20 is closed and provide an electrical signal (door closing signal) corresponding to the closing of the door 20 to the controller 150.

For example, the door closing sensor 140 may include a micro switch or a reed switch.

The controller 150 may include a processor 151 and a memory 152. The controller 150 may output a control signal for controlling the control panel 110, the microphone 120, the sensor module 130, the door closing sensor 140, the driver 160, and/or the bypass doors 100, 200, 300, 400, and 500.

The controller 150 may include the memory 152 configured to store or memorize programs (a plurality of instructions) or data for processing signals and providing control signals.

The memory 152 may include a volatile memory such as Static Random Access Memory (S-RAM) and Dynamic Random Access Memory (D-RAM), and a non-volatile memory such as Read Only Memory (ROM), and Erasable Programmable Read Only Memory (EPROM). The memory 152 may be integrally formed with the processor 151 or provided as a semiconductor device separated from the processor 151.

The processor 151 may further include a processing core (e.g., an arithmetic circuit, a memory circuit, and a control circuit) that processes signals based on programs or data stored in the memory 152 and outputs control signals.

The processor 151 may process a user input signal of the control panel 110 and identify the user input. For example, the processor 151 may identify a user input for opening or closing the door 20 or a user input for controlling the clothes care course in the care compartment 11.

Further, the processor 151 may control the driver 160 based on a user input signal of the control panel 152. Particularly, the processor 151 may control the rotational speed of the blowing fan 50 or control the operation of the steam module 70 or the heat exchanger 30.

The processor 151 may process a voice signal of the microphone 120 and identify a user input based on the voice. For example, the processor 151 may control the driver 160 based on a user input signal of the microphone 120. Particularly, the processor 151 may control the rotational speed of the blowing fan 50 or control the operation of the steam module 70 or the heat exchanger 30.

The controller 150 may control the bypass doors 100, 200, 300, 400, and 500 to open or close the bypass openings 101, 201, 301, 401, and 501.

Although not shown in the drawing, the controller 150 may control the locker 105 configured to fix the position of the bypass door 100 as shown in FIG. 7.

Figure 13:
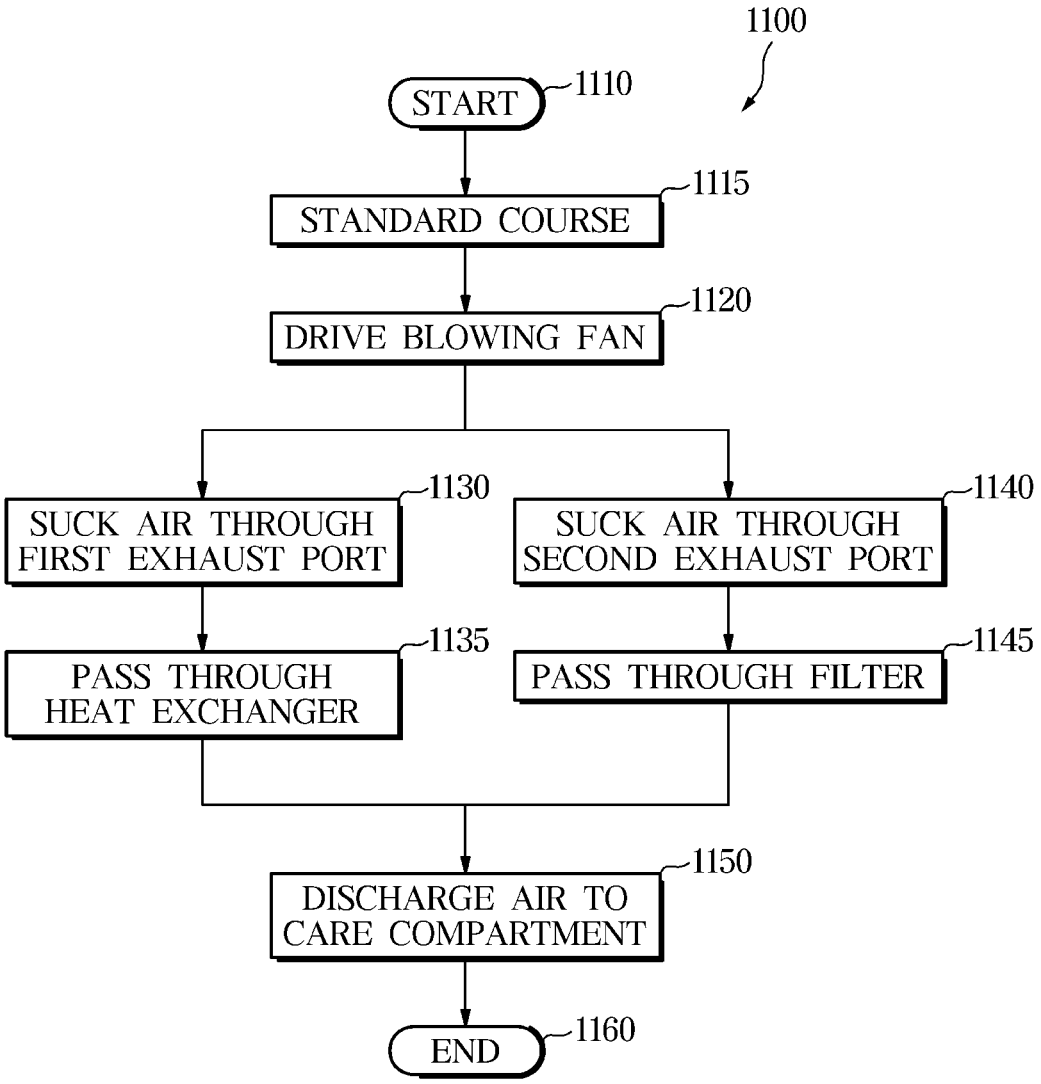
FIG. 13 is a flowchart illustrating a method of controlling the clothes care apparatus in the standard course according to an embodiment of the disclosure.
Figure 14:
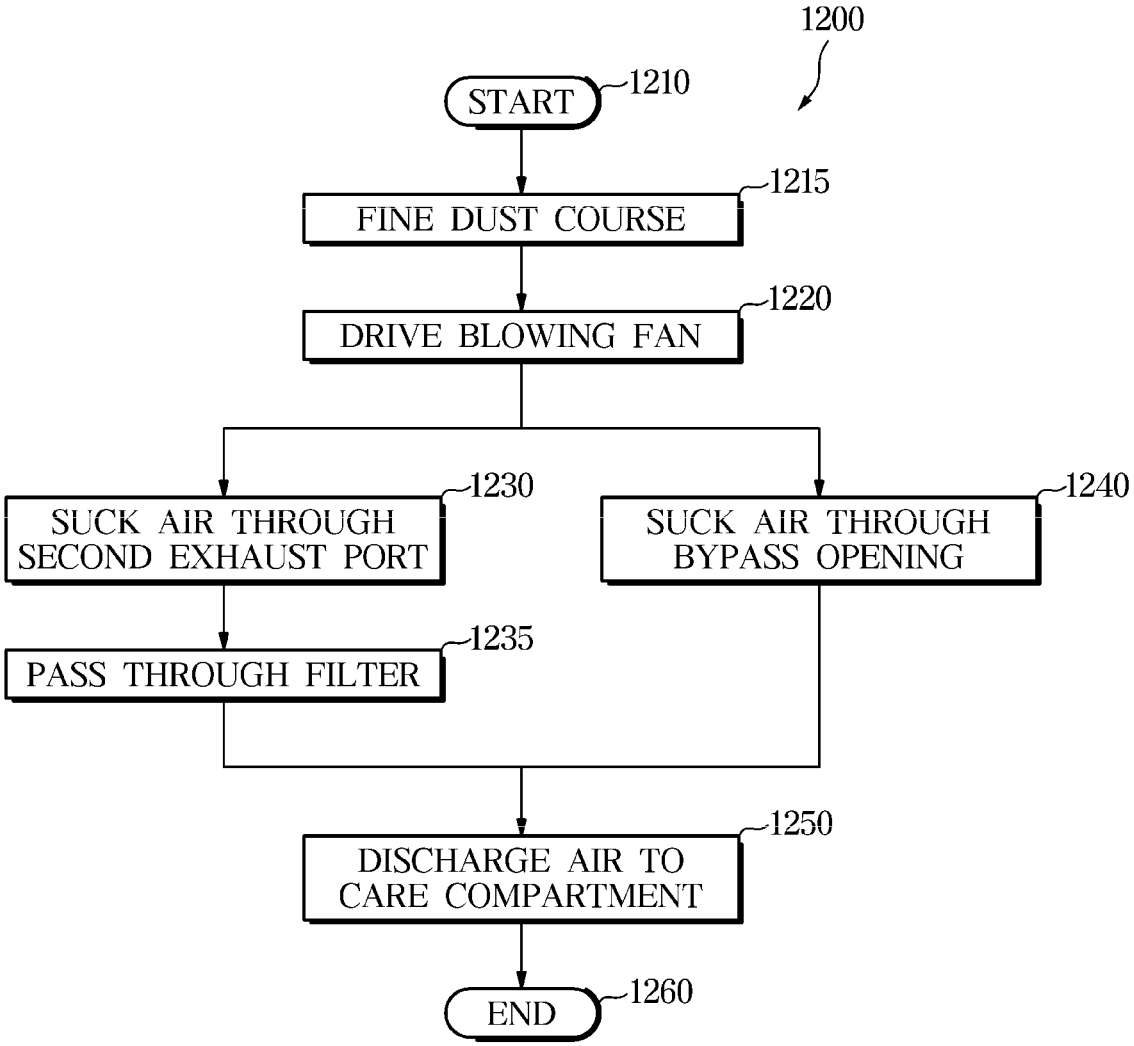
FIG. 14 is a flowchart illustrating a method of controlling the clothes care apparatus in the fine dust course according to an embodiment of the disclosure.

FIG. 13 is a flowchart illustrating a method of controlling the clothes care apparatus in the standard course according to an embodiment of the disclosure. FIG. 14 is a flowchart illustrating a method of controlling the clothes care apparatus in the fine dust course according to an embodiment of the disclosure.

Referring to FIGS. 13 and 14, the clothes care apparatus 1 may be controlled differently depending on the standard course or the fine dust course.

In the standard course (1100) of the clothes care apparatus 1, the clothes care apparatus 1 may start an operation (1110) as shown in FIG. 13. The clothes care apparatus 1 may receive an input for the standard course from a user (1115).

In response to receiving the input related to the standard course from the user, the clothes care apparatus 1 may drive the blowing fan (1120). The rotational speed of the blowing fan 50 (refer to FIG. 6) in the standard course 1100 may be between approximately 1750 and 1800 rpm.

A portion of the airflow generated by the blowing fan 50 and supplied to the care compartment 11 may be sucked into the first exhaust flow path 32 through the first exhaust port 31*a* (1130). The airflow discharged to the first exhaust flow path 32 through the first exhaust port 31*a* may pass through the heat exchanger 30 (1135).

Another portion of the airflow generated by the blowing fan 50 and supplied to the care compartment 11 may be sucked into the second exhaust flow path 42 through the second exhaust port 41*c* (1140). The airflow discharged into the second exhaust flow path 42 through the second exhaust port 41*c* may pass through the filter 43 (1145).

The airflow flowing along the first exhaust flow path 32 or the second exhaust flow path 42 may pass through the blowing fan 50 through the circulation flow path 52 and then be discharged back to the care compartment 11 through the supply port 51*b* (1150). According to a user end input or an end signal of a determined course, the clothes care apparatus 1 may end the care course on the clothes (1160).

In the fine dust course (1200) of the clothes care apparatus 1, the clothes care apparatus 1 may start an operation (1210) as shown in FIG. 14. The clothes care apparatus 1 may receive an input for the fine dust course from a user (1215).

In response to receiving the input related to the fine dust course from the user, the clothes care apparatus 1 may drive the blowing fan (1220). The rotational speed of the blowing fan 50 in the fine dust course 1100 may be approximately 2200 rpm.

A portion of the airflow generated by the blowing fan 50 and supplied to the care compartment 11 may be sucked into the second exhaust flow path 42 through the second exhaust port 41*c* (1230). The airflow discharged to the second exhaust flow path 42 through the second exhaust port 41*c* may pass through the filter 43 (1235).

Another portion of the airflow generated by the blowing fan 50 and supplied to the care compartment 11 may be sucked into the circulation flow path 52 through the bypass opening 101 (1240).

The airflow introduced into the circulation flow path 52 through the second exhaust flow path 42 or the bypass opening 101, 201, 301, 401, or 501 may pass through the blowing fan 50 and then be discharged back to the care compartment 11 through the supply port 51*b* (1250). According to a user end input or an end signal of a determined course, the clothes care apparatus 1 may end the care course on the clothes (1260).

Figure 15:
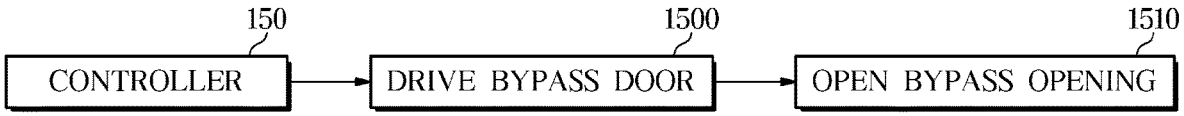
FIG. 15 is a flowchart illustrating a control method of a controller controlling the bypass door according to an embodiment of the disclosure.

FIG. 15 is a flowchart illustrating a control method of a controller controlling the bypass door according to an embodiment of the disclosure. Referring to FIG. 15, the controller 150 may drive the bypass doors 100, 200, 300, 400, and 500 according to a user input or a determined clothes care course (1500).

The bypass doors 100, 200, 300, 400, and 500 driven by the controller 150 may open or close the bypass openings 101, 201, 301, 401, and 501. At this time, in response to the clothes care apparatus 1 in the fine dust course, particularly, in response to the rotational speed of the blowing fan 50 (refer to FIG. 6) being greater than or equal to the predetermined rotational speed, the controller 150 may control the bypass doors 100, 200, 300, 400, and 500 to open the bypass openings 101, 201, 301, 401, and 501. Accordingly, the bypass openings 101, 201, 301, 401, and 501 may be opened (1510).

As is apparent from the above description, a clothes care apparatus may have a relatively high efficiency because a bypass door is configured to open a bypass opening in response to a high pressure in a care compartment in a fine dust course.

Further, a clothes care apparatus may have a relatively high efficiency by including a controller configured to control a bypass door to open a bypass opening in a fine dust course.

Example embodiments of the disclosure may provide a clothes care apparatus including a main body including a care compartment provided to receive clothes and including a first exhaust port, a second exhaust port and a supply port, a heat exchanger disposed in the main body, and a blowing fan disposed between the main body and the care compartment and configured to generate airflow supplied to the care compartment. The clothes care apparatus may include a first exhaust flow path provided to guide the airflow discharged through the first exhaust port to allow the airflow to pass through the heat exchanger, a circulation flow path provided to guide the airflow to allow the airflow to pass through the blowing fan and to be supplied to the care compartment through the supply port, and a second exhaust flow path provided to guide the airflow discharged through the second exhaust port and the airflow flowing along the first exhaust flow path to allow the airflow to pass through the circulation flow path. The clothes care apparatus may include a bypass opening provided to connect the care compartment and the circulation flow path so as to form a bypass flow path in which a portion of the airflow directly flows from the care compartment into the circulation flow path without passing through the exhaust flow path, and a bypass door configured to open and close the bypass opening.

The bypass door may be configured to open the bypass opening in response to a rotational speed of the blowing fan being greater than or equal to a predetermined rotational speed.

The bypass door may be configured to close the bypass opening in response to the rotational speed of the blowing fan being less than the predetermined rotational speed.

The bypass door may include a door member configured to open and close the bypass opening, a hinge shaft provided at a lower portion of the door member and configured to rotate the door member relative to a rear surface of the care compartment, and an elastic member configured to elastically bias the bypass door to allow the bypass door to be moved in a direction to close the bypass opening.

Example embodiments of the disclosure may provide a clothes care apparatus includes a main body including a care compartment including an exhaust port and a supply port, a heat exchanger disposed under the care compartment, and a blowing fan disposed above the care compartment and configured to generate airflow supplied to the care compartment. The clothes care apparatus may include an exhaust flow path provided to guide the airflow discharged through the exhaust port, which is arranged on a bottom surface of the care compartment, to allow the airflow to pass through the heat exchanger, a circulation flow path provided to communicate with the exhaust flow path and provided to guide the airflow to allow the airflow to pass through the blowing fan and to be supplied to the care compartment through the supply port, a bypass opening provided to connect the care compartment and the circulation flow path so as to form a bypass flow path in which a portion of the airflow directly flows from the care compartment into the circulation flow path without passing through the exhaust flow path, and a bypass door configured to open and close the bypass opening. The clothes care apparatus may include a controller configured to control the bypass door to allow the bypass door to open and close the bypass opening in response to a rotational speed of the blowing fan being greater than or equal to a predetermined rotational speed.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes care apparatus comprising:

a main body;

a care compartment in the main body, and including:

an exhaust port, and a supply port;

a heat exchanger disposed in the main body;

a blowing fan disposed in the main body and configured to generate airflow that is supplied to the care compartment through the supply port;

an exhaust flow path to guide airflow discharged from the care compartment through the exhaust port to pass through the heat exchanger;

a circulation flow path to communicate with the exhaust flow path to guide airflow from the exhaust flow path to pass through the blowing fan to the supply port;

a bypass opening to connect the care compartment and the circulation flow path; and a bypass door configured to open and close the bypass opening so that:

when the bypass opening is open, at least a portion of the airflow supplied to the care compartment flows directly from the care compartment into the circulation flow path without passing through the exhaust flow path, and when the bypass opening is closed, none of the airflow supplied to the care compartment flows directly from the care compartment into the circulation flow path.

2. The clothes care apparatus of claim 1, wherein the bypass door is configured to open the bypass opening in response to a rotational speed of the blowing fan being greater than or equal to a predetermined rotational speed.

3. The clothes care apparatus of claim 2, wherein the bypass door is configured to close the bypass opening in response to the rotational speed of the blowing fan being less than the predetermined rotational speed.

4. The clothes care apparatus of claim 1, wherein the bypass door includes:

a door member configured to open and close the bypass opening, and a hinge shaft at a lower portion of the door member, and the door member is configured to rotate about the hinge shaft.

5. The clothes care apparatus of claim 4, wherein the bypass door includes an elastic member configured to elastically bias the door member in a direction to close the bypass opening.

6. The clothes care apparatus of claim 5, wherein the elastic member includes a torsion spring.

7. The clothes care apparatus of claim 1, wherein the exhaust flow path is under the care compartment, and the circulation flow path is at a rear side of the care compartment.

8. The clothes care apparatus of claim 1, wherein the heat exchanger is disposed under the care compartment, and the blowing fan is disposed above the care compartment.

9. The clothes care apparatus of claim 1, wherein the bypass door is installed to be slidable on a rear surface of the care compartment to open and close the bypass opening.

10. The clothes care apparatus of claim 1, wherein the exhaust port is a first exhaust port, the exhaust flow path is a first exhaust flow path, the clothes care apparatus further comprises:

a second exhaust flow path arranged between the first exhaust flow path and the circulation flow path so that the first exhaust flow path and the circulation flow path to communicate with each other through the second exhaust flow path, and a second exhaust port arranged so that a portion of the airflow supplied to the care compartment is discharged through the second exhaust port to the second exhaust flow path, and the bypass opening is disposed above the second exhaust port.

11. The clothes care apparatus of claim 1, further comprising:

a steam module including:

a steam generator to generate steam, a steam spray port disposed at a rear side of the care compartment, and a steam spray nozzle to receive the steam from the steam generator and configured to spray the steam into the care compartment through the steam spray port, wherein the bypass opening is disposed above the steam spray port.

12. The clothes care apparatus of claim 1, wherein the bypass door includes a solenoid valve.

13. The clothes care apparatus of claim 1, wherein the bypass door includes a step motor.

14. The clothes care apparatus of claim 1, wherein the bypass door includes a hydraulic cylinder.

15. The clothes care apparatus of claim 1, further comprising:

a controller configured to control the bypass door to open and close the bypass opening.

* * * * *